US011434920B2

(12) United States Patent
Keck

(10) Patent No.: US 11,434,920 B2
(45) Date of Patent: Sep. 6, 2022

(54) AXIAL FLOW PUMP

(71) Applicant: VOITH PATENT GMBH, Heidenheim (DE)

(72) Inventor: Benjamin Keck, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 270 days.

(21) Appl. No.: 16/641,366

(22) PCT Filed: Aug. 14, 2018

(86) PCT No.: PCT/EP2018/071994
§ 371 (c)(1),
(2) Date: Feb. 24, 2020

(87) PCT Pub. No.: WO2019/038130
PCT Pub. Date: Feb. 28, 2019

(65) Prior Publication Data

US 2020/0224666 A1 Jul. 16, 2020

(30) Foreign Application Priority Data

Aug. 23, 2017 (DE) ..... 10 2017 119 241.7

(51) Int. Cl.

| | |
|---|---|
| ***F04D 29/18*** | (2006.01) |
| ***F04D 29/046*** | (2006.01) |
| ***F04D 3/00*** | (2006.01) |
| *F04D 13/06* | (2006.01) |
| *F04D 29/06* | (2006.01) |
| *F04D 29/52* | (2006.01) |
| *F04D 29/54* | (2006.01) |

(52) U.S. Cl.
CPC ..... *F04D 29/181* (2013.01); *F04D 29/046* (2013.01); *F04D 3/005* (2013.01); *F04D 13/06* (2013.01); *F04D 29/061* (2013.01); *F04D 29/528* (2013.01); *F04D 29/548* (2013.01)

(58) Field of Classification Search
CPC ..... F04D 29/046; F04D 29/181; F04D 3/005; F04D 13/06; F04D 29/061; F04D 29/528; F04D 29/548
USPC ..... 417/423.12
See application file for complete search history.

(56) References Cited

U.S. PATENT DOCUMENTS

| | | | | |
|---|---|---|---|---|
| 4,213,745 A | | 7/1980 | Roberts | |
| 5,102,308 A | | 4/1992 | Bordelon | |
| 6,102,674 A | * | 8/2000 | Strauch | F04D 13/0646 417/423.12 |

(Continued)

FOREIGN PATENT DOCUMENTS

| | | |
|---|---|---|
| CH | 287346 A | 11/1952 |
| CN | 1609455 A | 4/2005 |

(Continued)

*Primary Examiner* — Patrick Hamo
(74) *Attorney, Agent, or Firm* — Laurence A. Greenberg; Werner H. Stemer; Ralph E. Locher

(57) ABSTRACT

An axial flow pump for pumping a liquid has a motor. The motor of the pump is arranged such that the liquid to be pumped flows around the motor. No elaborate rotary lead-throughs of the pump shaft through the pipe system are needed. Furthermore, the bearings of the motor are lubricated by the liquid to be pumped, thereby avoiding risky oil lubrication. As a result, the axial flow pump is suitable for use in drinking water pipelines.

11 Claims, 2 Drawing Sheets

(56) References Cited

U.S. PATENT DOCUMENTS

| | | | | |
|---|---|---|---|---|
| 6,702,555 | B2 * | 3/2004 | Allen | F04D 3/00 417/423.1 |
| 7,128,523 | B2 | 10/2006 | Aizawa et al. | |
| 7,535,138 | B2 * | 5/2009 | Chin | F04D 3/00 310/87 |
| 2009/0220359 | A1 * | 9/2009 | Koeck | B60T 17/02 417/321 |
| 2013/0149142 | A1 | 6/2013 | Oyamada et al. | |

FOREIGN PATENT DOCUMENTS

| | | | |
|---|---|---|---|
| CN | 101112628 | A | 1/2008 |
| CN | 101235824 | A | 8/2008 |
| CN | 201339585 | Y | 11/2009 |
| CN | 202250889 | U | 5/2012 |
| DE | 102012212423 | A1 | 1/2014 |
| GB | 250177 | A | 7/1926 |

* cited by examiner

AXIAL FLOW PUMP

BACKGROUND OF THE INVENTION

Field of the Invention:

The present invention relates to an axial flow pump for installation in a pipe or tunnel system.

The axial flow pumps known from the prior art are characterized in that the drive of the pump runner is arranged outside the water-carrying area. Such an axial flow pump is set forth for example in CH 150076. Such a pump requires a sealed leadthrough of the pump shaft and an angular gear or an arc-shaped arrangement of the water-carrying part of the pump.

SUMMARY OF THE INVENTION

The object of this invention is to specify an axial flow pump that may be integrated into an existing pipe or tunnel system without major structural changes to the existing structure. In addition, the axial flow pump according to the invention is low-maintenance and environmentally friendly, because the axial flow pump according to the invention is free of substances that cause water pollution.

The inventor has found that this object may be accomplished by an axial flow pump as claimed. Advantageous embodiments are set forth in the dependent claims.

The solution according to the invention is explained below with reference to the drawings. The drawings illustrate the following:

DETAILED DESCRIPTION OF THE INVENTION

Figure 1:
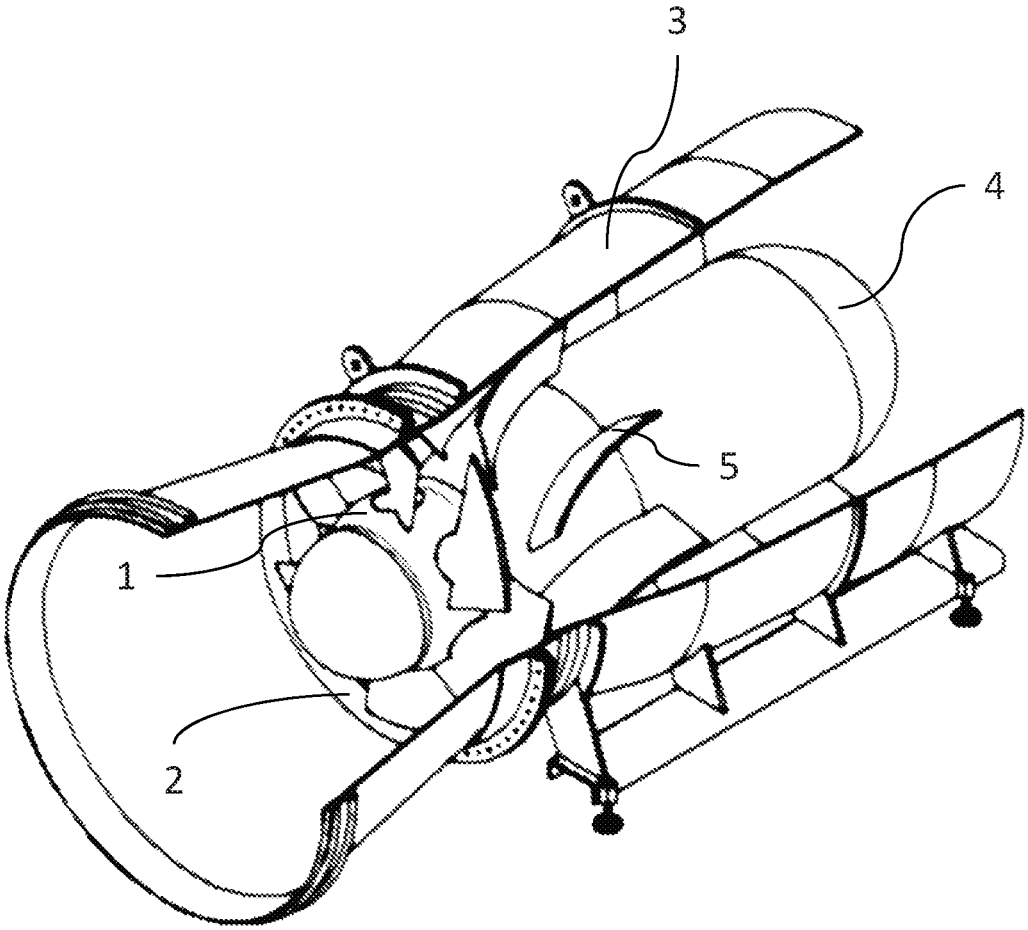
FIG. 1 Axial flow pump according to the invention.

FIG. 1 shows an axial flow pump according to the invention. The pump housing, marked 3, is cut away to show the pump below. The pump comprises an runner marked 1. The runner 1 is arranged inside an runner chamber that wraps around it, marked 2. The runner chamber 2 is part of the pump housing and may be spherical or cylindrical in shape. In the first case, the runner chamber 2 is divided into sections. The pump further comprises a motor, which is marked 4 and enclosed by a motor housing. The runner 1 is connected to the motor 4 in such a way that the motor may drive it; it comprises a hub and a multiplicity of blades. The runner blades may be rigidly or rotatably mounted and connected to the hub of the runner 1. The motor 4 may be designed to rotate at constant or variable speed. The unit, consisting of the motor 4 and runner 1, is held centrally in the pump housing 3 by a multiplicity of cross members, one of which is marked 5. The pump housing 3, which wraps around the pump, is substantially tubular in shape, although the diameter of these tubes need not be constant, and has a first opening, located near the runner 1, for receiving the pumped liquid, and a second opening, located near the motor 4, for discharging the pumped liquid. The cross members 5 are supported, on the outside on the pump housing 3 and on the inside on the motor housing. The liquid entering the pump from the first opening during operation is imparted with a certain amount of swirl as it passes the runner. The cross members are designed in such a way that they may reduce the swirl of the liquid. During operation, the pumped liquid flows around the motor housing. The two openings of the pump housing 3 may be circular, which makes it easier to integrate the axial pump into an existing pipe system. In other installation situations, however, the openings may also have other cross-sectional shapes. The pump housing 3 may have devices to support the pump on the ground or to suspend the pump from suitable support structures.

Figure 2:
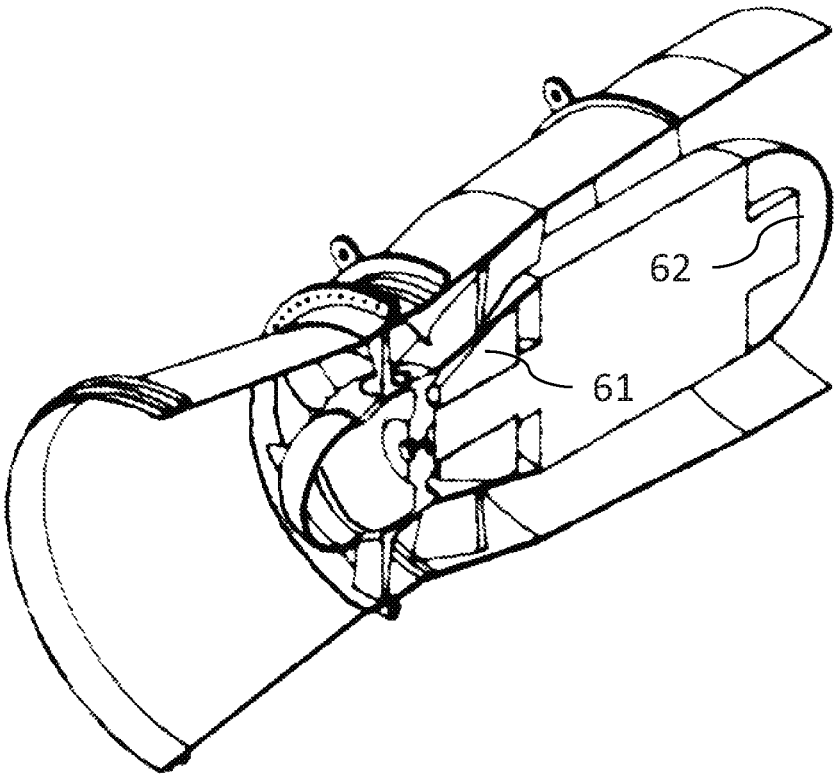
FIG. 2 Cross-section of axial flow pump according to the invention.

FIG. 2 shows a longitudinal section of a pipe axial pump according to the invention, permitting a view into the motor housing. The motor 4 has two bearings. A first bearing, marked 61, is designed as a combined thrust and guide bearing and is arranged between the runner 1 and the rotor of the motor 4. A second bearing, marked 62, is designed as a guide bearing and is arranged at the end of the motor housing facing away from the runner 1. Both bearings 61 and 62 are lubricated by the pumped liquid, which is made possible by the fact that the motor housing is not sealed against the liquid that flows around the motor housing, so that the pumped liquid fills the motor housing. As a result, lubrication by oil, which could potentially contaminate the pumped liquid, is avoided. Consequently, the axial pipe pump according to the invention may also be used to pump drinking water.

Because the motor 4, which drives the runner 1, is arranged within the liquid-carrying area, there is no need for an outward-fed pump shaft and the associated sealing of the rotary leadthrough. Only the control and power cables need to be fed to the exterior. In addition, a curved arrangement of the liquid-carrying part of the pump is not required, and consequently the pump according to the invention is much smaller and more compact than comparable classic axial pumps. The pump according to the invention may thus be easily integrated into an existing pipe or tunnel system without major structural changes. As a result of lubrication using the pumped liquid, the pump is largely maintenance-free and environmentally friendly. In the event of maintenance, the entire pump may be removed in one piece or in parts and overhauled.

Depending on the use case, the pump according to the invention may be installed at any angle in an existing or new pipe or tunnel system. The liquid inlet and outlet of the axial flow pump may be adapted according to the use case (flange connection, direct connection to the existing pipe or tunnel system, etc.).

One possible application of the axial flow pump according to the invention is the installation of a horizontal version of the pump in a drinking water pumping station to increase the suction pressure of the main pumps.

The invention claimed is:

1. An axial flow pump for pumping a liquid, the axial flow pump comprising:

a rotatably mounted runner having a hub and a multiplicity of runner blades connected to said hub;

a motor encased in a motor housing, said motor having a rotor;

a tubular pump housing formed with a runner chamber, a first opening for receiving the liquid to be pumped, and a second opening for discharging the liquid to be pumped, wherein said runner chamber is wrapped around said runner, said first opening is arranged near said runner, and said second opening is arranged near said motor;

said motor being connected to said runner for driving said runner, said motor together with said runner forming a unit, and said motor including a combined thrust-and-guide bearing arranged between said runner and said rotor, and a guide bearing arranged at an end of said motor housing opposite said runner;

said motor being disposed within an area of the pump through which the liquid flows during pump operation;

a plurality of cross members configured to maintain said unit formed of said motor and said runner centered in said pump housing, said cross members being configured to reduce a swirl of the liquid passing said runner during pump operation; and wherein said motor housing is filled and flowed around with the liquid during pump operation so that the liquid may lubricate said thrust-and-guide bearing and said guide bearing.

2. The axial flow pump according to claim 1, wherein said runner blades are rigidly connected with said hub.

3. The axial flow pump according to claim 1, wherein said runner blades are rotatably mounted and connected to said hub.

4. The axial flow pump according to claim 1, wherein said runner chamber has a cylindrical shape.

5. The axial flow pump according to claim 1, wherein said runner chamber is ball-shaped and divided into sections.

6. The axial flow pump according to claim 1, wherein said pump housing is formed with openings having a circular cross-section.

7. The axial flow pump according to claim 1, wherein said motor is configured to be able to drive said runner at a constant speed.

8. The axial flow pump according to claim 1, wherein said motor is configured to be able to drive said runner at variable speed.

9. The axial flow pump according to claim 1, wherein said pump housing comprises supports configured to support the pump on the ground.

10. The axial flow pump according to claim 1, wherein said pump housing comprises suspension supports for suspending the pump from a support structure.

11. The axial flow pump according to claim 1, wherein the pump is configured to pump drinking water as the liquid.

* * * * *